United States Patent [19]

Burton et al.

[11] 4,162,180

[45] Jul. 24, 1979

[54] PRODUCING EMBOSSED WALL- OR CEILING-COVERING OF CELLULOSIC PULP AND TWO DIFFERENT DISCRETE THERMOPLASTIC MATERIALS

[75] Inventors: Arthur Burton, Tameside; Roy Conway, Dukinfield, both of England

[73] Assignee: Imperial Chemical Industries Limited, London, England

[21] Appl. No.: 777,425

[22] Filed: Mar. 14, 1977

[30] Foreign Application Priority Data

Mar. 30, 1976 [GB] United Kingdom ..... 12736/76

[51] Int. Cl.[2] ..... B31F 1/08; B32B 31/00; D02G 3/00

[52] U.S. Cl. ..... 156/220; 156/290; 156/306; 428/359; 428/360; 428/514

[58] Field of Search ..... 156/306, 290, 220; 428/514, 359, 360

[56] References Cited

U.S. PATENT DOCUMENTS

| | | | |
|---|---|---|---|
| 2,464,301 | 3/1949 | Francis, Jr. | 428/280 X |
| 3,562,043 | 2/1971 | Eddy | 156/209 |
| 3,595,731 | 7/1971 | Davies et al. | 428/296 X |
| 3,671,615 | 6/1972 | Price | 428/2 |
| 3,956,541 | 5/1976 | Pringle | 428/2 |

FOREIGN PATENT DOCUMENTS

| | | |
|---|---|---|
| 2226330 | 1/1973 | Fed. Rep. of Germany . |
| 36-16460 | 9/1961 | Japan . |

OTHER PUBLICATIONS

Japanese Patent Application Pre-Publication #13606/73, Kogyo Co., 2/21/73.

*Primary Examiner*—P. C. Ives

*Attorney, Agent, or Firm*—Cushman, Darby & Cushman

[57] ABSTRACT

A method of producing a wall or ceiling covering that is dry-stripable from the wall, is flexible and has good opacity, and will fully retain an embossed pattern even when the sheet is soaked with a water based adhesive. A sheet is provided containing 10 to 90% by weight of cellulose pulp fibres and 10 to 90% by weight of discontinuous fibres of two different synthetic thermoplastic polymeric materials. Staple fibres may also be added. The sheet is then heated to a temperature intermediate the temperature of plasticity of the two different thermoplastic materials so that the fibres of one of the thermoplastic materials are rendered plastic and fused together, the other thermoplastic material retaining its fibre structure.

4 Claims, No Drawings

PRODUCING EMBOSSED WALL- OR CEILING-COVERING OF CELLULOSIC PULP AND TWO DIFFERENT DISCRETE THERMOPLASTIC MATERIALS

This invention relates to a fibrous reinforced sheet-type wall-covering or ceiling covering and to a method for producing such a wallcovering or ceiling covering.

According to the present invention a method of producing a wall- or ceiling- covering comprises providing a sheet containing from 10 to 90% by weight of cellulosic fibres and from 10 to 90% by weight of discontinuous fibres of two different synthetic thermoplastic polymeric materials, heating the sheet to a temperature intermediate the temperatures of plasticity of the two different thermoplastic materials so that the fibres of one of the thermoplastic materials are rendered plastic and fuse together to form a three dimensional network in the sheet while the other thermoplastic material retains its fibrous structure.

We also provide a wallcovering or ceiling covering comprising a sheet containing from 10 to 90% by weight of cellulosic fibres and from 10 to 90% by weight of two different synthetic thermoplastic polymeric materials, one of the thermoplastic polymeric materials being in the form of discontinuous fibres and the other thermoplastic polymeric material being in the form of a fused, three-dimensional, network of the material. In such a wallcovering we prefer that the synthetic fibrous material constitutes between 30 and 70% of the total content of synthetic thermoplastic polymeric material in the wallcovering.

Such a wallcovering has a number of advantages over conventional wallcoverings. Even though the wallcovering is dry-strippable from the wall, it is flexible and has good opacity. Furthermore if, as usually will be the case, the wallcovering is provided with an embossed pattern this is fully retained when the sheet is soaked with a water based adhesive.

The sheet may be made by a conventional paper making technique from a mixture of cellulose pulp and discontinuous fibres of the two different thermoplastic polymeric materials. The cellulose pulp used may be either a chemical, semi-chemical or mechanical pulp. It is preferred, however, that the cellulose pulp is a chemical pulp. We also prefer that the sheet is produced from a pulp mixture containing from 20 to 40% of cellulose pulp and from 60 to 80% of the discontinuous fibres of synthetic thermoplastic polymeric material, the percentages being expressed as weight of dry material (wdm).

When making the sheet, it is preferable to incorporate the cellulose pulp in a suspension of the discontinuous fibres and then to subject the mixture to a refining and possibly pulp dispersion process in any equipment which can ensure intimate mixing of the components. Preferably a wide angle cone refiner or a perforated or toothed disc refiner is used. Finally the sheet is formed by conventional paper making methods.

Discontinuous fibres of a synthetic thermoplastic polymeric material are understood to mean fibrous structures of a synthetic thermoplastic polymeric material comprising very thin filaments of a micron order thickness and having a length less than 20 mm, and preferably less than 5 mm.

The fibres used may be selected from the group consisting of polyolefins, polyamides, polyesters, polyurethanes, polycarbonates, vinyl and acrylic resins. Essentially, of course, it will be necessary to select two different fibre materials having a sufficient difference in plasticity temperature to allow the sheet to be heated without both of the materials fusing and forming a non-fibrous network. In practice both of the fibre materials can be polymers of an alpha-olefine containing from 2 to 6 carbon atoms. In particular we find that excellent results are achieved when the two different fibre materials are polyethylene and polypropylene whose temperatures of plasticity are about 135° C. and 170° C. respectively.

We also find it beneficial to include in the sheet a small proportion of a third fibre such as staple fibre of, for example, rayon or nylon. In particular we prefer that up to 10% by weight of the fibres in the sheet are of a staple fibre. We have found that the presence of a staple fibre in the sheet has the effect of increasing the physical properties, such as tear strength, to a level which requires a lower contribution from the fused, three-dimensional, network of thermoplastic material.

Also included in the sheet may be any of the usual additives such as binders, pigments and fillers.

The wallcovering described herein will also usually be provided with an embossed and/or printed decoration. In particular when the sheet is heated in order to render one of the fibrous thermoplastic materials plastic it is convenient to provide the sheet with an embossed design by embossing the still-hot sheet. Conveniently the sheet is simultaneously heated and embossed by means of a hot embossing roller. The sheet can also be provided with a suitable printed decoration before or after the sheet has been embossed.

The invention will now be described with reference to the following Examples:

EXAMPLE 1

A wallcovering according to the invention was produced as follows:

A paper sheet was made on a conventional paper making machine from a mixture comprising:

(1) 30% by weight (dry) of cellulose wood pulp fibres derived from a chemical pulp.

(2) 35% by weight (dry) of fibres of polyethylene having an average fibre length of 2.5 mm and an average fibre thickness of 1 μm.

(3) 35% by weight (dry) of fibres of polypropylene having an average fibre length of 2.5 mm and an average fibre thickness of 1 μm.

(4) Clay and titanium dioxide filler.

One surface, the decorative surface, of the sheet was printed by a surface printing technique using conventional inks.

The sheet was heated to a temperature of 160° C. by passing it through an oven. (At this temperature the fibres of polyethylene were rendered plastic and fused together to form a three-dimensional network in the sheet).

The still hot sheet was embossed by passing it through the nip formed between a suitable engraved embossing roller and a counter roller.

The product so formed was then rolled up in the manner of a conventional wallcovering.

A hanging trial was then carried out. A wall having a clean surface was pasted with an adhesive sold by Polycell Holdings Limited under the Registered Trade Mark "Polymura" using a roller. A roll of the wallcovering was unrolled and the working surface of the sheet was offered up to the wall, smoothed into place and cut neatly at the top and bottom of the wall. This was repeated until the wall was completely decorated.

An inspection of the decorated wall showed that the embossed design in the sheet had not been lost during or subsequent to the wall application process.

Subsequently, when it was decided to redecorate the wall, it was found that the wallcovering could be removed from the wall in large pieces without soaking.

EXAMPLE 2

Example 1 was repeated in entirety except that the paper sheet was made from a mixture comprising:

(1) 30% by weight (dry) of paper fibres derived from a chemical pulp.

(2) 30% by weight (dry) of fibres of polyethylene having an average fibre length of 2.5 mm and an average fibre thickness of 1 micron.

(3) 30% by weight (dry) of fibres of polypropylene having an average fibre thickness of 1 micron.

(4) 10% by weight (dry) of fibres of viscose rayon.

(5) Clay and titanium dioxide filler.

We claim:

1. A method of producing an embossed wall- or ceiling- covering comprising the steps of:

providing a sheet containing from 10 to 90% by weight of cellulosic pulp fibres and from 10 to 90% by weight of discontinuous fibres of two different discrete synthetic thermoplastic polymeric materials, the fibres of the two different materials being independent, heating the sheet to a temperature intermediate the temperatures of plasticity of the two different thermoplastic materials so that the fibres of one of the thermoplastic materials are rendered plastic and fuse together, the other thermoplastic material retaining its fibrous structure, and embossing the sheet while still hot from said heating step.

2. A method as claimed in claim 1 in which the sheet which is provided contains from 20 to 40% by weight of cellulose fibres and from 60 to 80% by weight of discontinuous fibres of the two synthetic thermoplastic polymeric materials.

3. A method as recited in claim 1 in which one synthetic polymeric material is in the form of discontinuous fibres of polypropylene, and the other synthetic polymeric material is polyethylene.

4. A method as recited in claim 1 wherein the sheet contains, as a further constituent thereof, a staple fibre.

* * * * *